US005177974A

United States Patent [19]

Uren et al.

[11] Patent Number: 5,177,974

[45] Date of Patent: Jan. 12, 1993

[54] STORAGE AND TRANSPORTATION OF LIQUID $CO_2$

[75] Inventors: Kevin R. Uren, Maroochydore; Clifford B. McMullen, Cairns; Brian Starr, Mooloolaba; Ian R. Tronc, Nerang, all of Australia

[73] Assignee: Pub-Gas International PTY. Ltd., Queensland, Australia

[21] Appl. No.: 10,248

[22] Filed: Jun. 23, 1988

[30] Foreign Application Priority Data

Nov. 19, 1986 [WO] PCT Int'l Appl. ..... PCT/AU86/00349

[51] Int. Cl.[5] ..... F17C 5/03

[52] U.S. Cl. ..... 62/47.1; 62/48.2; 62/49.2; 62/384

[58] Field of Search ..... 62/47.1, 48.2, 384, 62/238.6, 49.2

[56] References Cited

U.S. PATENT DOCUMENTS

| | | | |
|---|---|---|---|
| 2,344,765 | 3/1944 | Dana et al. | 62/48.1 |
| 3,282,305 | 11/1966 | Antolak | 62/48.1 |
| 3,371,497 | 3/1968 | Singleton | 62/47.1 |
| 3,628,347 | 12/1971 | Puckett | 62/48.1 |
| 3,710,248 | 1/1973 | Leonard | 62/54 |
| 3,710,584 | 1/1973 | Leonard | 62/54 |
| 3,827,246 | 8/1974 | Moen et al. | 62/48.1 |
| 4,186,562 | 2/1980 | Tyree, Jr. | 62/53.2 |
| 4,211,085 | 7/1980 | Tyree, Jr. | 62/54.1 |
| 4,224,801 | 9/1980 | Tyree, Jr. | 62/54.1 |
| 4,295,337 | 10/1981 | Johnson et al. | 62/384 |
| 4,565,161 | 1/1986 | Choquette | 62/238.6 |
| 4,693,737 | 9/1987 | Tyree, Jr. | 62/54.1 |

FOREIGN PATENT DOCUMENTS

| | | |
|---|---|---|
| 592298 | 2/1933 | Fed. Rep. of Germany . |
| 678986 | 7/1939 | Fed. Rep. of Germany . |
| 692326 | 6/1940 | Fed. Rep. of Germany . |
| 729345 | 12/1942 | Fed. Rep. of Germany . |
| 8131311 | 2/1983 | Fed. Rep. of Germany . |
| 2130315 | 11/1972 | France . |
| 2270513 | 5/1974 | France . |
| 1148062 | 4/1969 | United Kingdom . |

OTHER PUBLICATIONS

SU 1164-507 A Jun. 30, 1985 Derwent English Language Abstract No. Q69 86-092353/14.

SU A 1160167 Jun. 7, 1985 Derwent English Language Abstract No. Q69 85-315908/50.

*Primary Examiner*—Ronald C. Capossela

*Attorney, Agent, or Firm*—Nixon & Vanderhye

[57] ABSTRACT

A system for transportation and storage of liquid carbon dioxide ($CO_2$) at low pressures in the region of 1600-2300 KPa comprises a mobile supply tank (20*a*, 20*b*) and an on side storage tank (70). The mobile supply tank (20*a*, 20*b*) and the on site storage tank (70) are thermally insulated and each tank is refrigerated by a refrigeration system (71) with an evaporator located in the upper gas space of each tank. The on site storage tank (70) is filled with liquid $CO_2$ by a conduit (36*a*) extending from near the bottom of the mobile supply tank (20*a*, 20*b*) via a filling port (72) on the on site storage tank to an opening near the bottom of the on site storage tank. A closed circuit system is achieved by a further conduit (37*a*) extending via an outlet port (73) from the gas space near the top of the site storage tank (70) to a gas space near the top of the mobile supply tank (20*a*, 20*b*).

11 Claims, 4 Drawing Sheets

STORAGE AND TRANSPORTATION OF LIQUID $CO_2$

This invention is concerned with the storage and transportion of liquid carbon dioxide ($CO_2$) and in particular to the storage and transportation of liquid $CO_2$ at relatively low pressures.

Carbon dioxide in gaseous form is used in large quantities in many industries. One of the major consumers of $CO_2$ is the hotel trade in the provision of draught carbonated beer and other carbonated beverages through a reticulated supply system.

Other consumers include manufacturers of carbonated beverages, manufacturers of dry ice, operators of welding machines requiring an inert $CO_2$ welding atmosphere, manufacturing operations using an inexpensive inert gas such as $CO_2$ for spraying of hollow vessels and the like.

For the sake of simplicity the following prior art discussion will be limited to the use of $CO_2$ by hoteliers but it should be understood that the problems and limitations associated with storage and transportation of $CO_2$ by prior art systems is generally common to all users.

Traditional prior art methods of storage and transportation of $CO_2$ required the use of steel cylinders measuring approximately 1.5 meters in length and about 0.25 meters in diameter. Such cylinders have a capacity of about 32 kg of $CO_2$ at about 14000 KPa. Because of the very high storage pressures required, the storage cylinders of necessity were extremely robust and in consequence extremely heavy to handle. The steel storage cylinders were designed for upright storage on a flat base and in consequence were extremely unstable due to small base area and a relatively high centre of mass. There are many recorded instances of injury and damage being caused by falling cylinders. In some cases the exposed filling/outlet valve has been broken during such a fall enabling the contents of the cylinder to be discharged at very high pressure. Work related injuries such as back injury, crushed limbs and the like can be attributed to handling of $CO_2$ cylinders.

Apart from the dangerous aspects of handling of $CO_2$ cylinders there are many inefficiencies associated with the storage and transportation of $CO_2$ in such cylinders, particularly for consumers of large amounts of $CO_2$.

The $CO_2$ cylinders are usually filled at a gas producing plant and then are transported great distances by road and/or rail to a user destination. When empty, the cylinders must be returned to the gas producing plant for refiling. Apart from excessive handling requirements and transportation charges, this necessitates the use of a very large number of cylinders to take into account turn around time from consumers, transportation time and maintenance and testing time. The high capital costs, handling, transportation, testing and maintenance costs are passed on to the consumer, usually in the form of a rental charge for the cylinders.

Steel cylinders, although durable from a physical handling point of view, are subject to internal corrosion due to moisture entrained in the $CO_2$ contained therein and safety regulations require frequent pressure testing as well as physical inspections before they are ultimately rejected as unsafe.

Of recent times there has been an attempt to overcome some of the problems associated with high pressure steel gas cylinders by utilizing aluminium cylinders. Although aluminium cylinders have a significantly reduced mass any advantage gained in ease of handling is offset or even totally negated by increased manufacturing costs combined with a lack of durability which necessitates frequent replacement.

Yet another problem associated with the use of high pressure cylinders is that most consumers actually use the $CO_2$ at relatively low pressures. For example a reticulated beer line in a hotel or bar may operate at about 70–125 KPa. This necessitates the use of a pressure reducing device, usually of the diaphragm type, to obtain a source of $CO_2$ at a required working pressure from a source of $CO_2$ stored at about 14000 KPa.

It is important to be able to control user pressure with considerable accuracy in order to avoid wastage of gas due to excessive flow rates and also to avoid wastage of beer due to excessive absorption of $CO_2$ leading to excessive frothing at the beer pouring tap.

Further problems are experienced by users of large volumes of $CO_2$. Firstly, in order to provide ready access for cylinder changeover, the cylinders are usually connected to a manifold arranged in a single bank extending for a considerable distance along, say, a wall. Due to delays in supply or unexpected demands on gas consumption, it is not uncommon to have on hand 50–100% additional supplies of gas and apart from storage problems, this necessitates considerable additional revenue being tied up in excess storage.

With a manifold supply system being fed by a plurality of cylinders, it is very difficult to determine reserves of gas supply in each cylinder. Usually a cellarman is required to constantly monitor pressure gauges associated with the manifold supply system. When a cylinder becomes empty and requires changing this allows a certain amount of air and possibly foreign matter to enter the gas supply line. Accordingly before a fresh cylinder of gas can be used it is necessary to sparge the gas supply and beer supply lines and to flush the beer supply line with fresh beer to avoid contamination. Apart from being very wasteful of beer this can be very disruptive to bar trading if this occurs during trading hours. It is not uncommon therefore for hoteliers to have to change over cylinders after trading hours and then sparge and flush the gas and beer lines in a single daily operation. This operation is not only very time consuming but is very wasteful of both gas and beer.

It is an aim of the present invention to provide a system for low pressure storage and transportation of liquid $CO_2$ which overcomes or at least alleviates the problems associated with prior art high pressure storage and transportation of liquid $CO_2$ and ultimate use of such gas from a high pressure source.

As used herein the expression "high pressure" as it relates to prior art storage and transportation of liquid $CO_2$ means pressures of the order of about 14000 KPa and "low pressure" as it relates to storage and transportation of liquid $CO_2$ according to the invention means pressures of the of about 1600–2300 KPa—slightly less than 1 order of magnitude in difference between the respective pressures.

According to one aspect of the invention there is provided a storage system for storage of liquid $CO_2$ at low pressure, said storage system comprising:

a pressure vessel having inlet means and outlet means for filling said vessel, said inlet means comprising a conduit having an opening communicating with the interior of said vessel adjacent a bottom wall of said vessel and said outlet means having an opening communicating with the interior of said vessel adjacent an upper wall of said vessel;

a cooling means located within said vessel in an upper part thereof in a region normally occupied by gaseous $CO_2$; and, a supply conduit for supply of gaseous $CO_2$, said supply conduit communicating with said region normally occupied by gaseous $CO_2$.

Suitably said cooling means comprises any means for cooling gaseous $CO_2$ and may include a heat exchanger such as a Peltier effect thermocouple or alternatively an evaporator associated with a compression or absorption refrigeration apparatus. Preferably the cooling means comprises an evaporator associated with a compression refrigeration apparatus.

Preferably the storage system includes means to indicate a liquid level within said pressure vessel.

Preferably a heating means is located within the lower portion of said pressure vessel in a region normally occupied by liquid $CO_2$. Suitably said heating means may be heated by waste heat from a condenser associated with said refrigeration system.

Preferably said heating means comprises an electrically energized heating element and more preferably said heating element is thermostatically controlled to maintain a volume of liquid $CO_2$ in said pressure vessel within predetermined temperature limits.

Most preferably said pressure vessel is thermally insulated.

Suitably said storage system comprises an integral structure including a refrigeration apparatus associated with said evaporator.

According to another aspect of the invention there is provided a system for transportation and delivery of low pressure liquid $CO_2$ comprising:

at least one storage tank having a gas inlet port communicating with an upper interior part of said tank and a liquid inlet/outlet port communicating with a lower interior part of said tank;

cooling means for maintaining liquid $CO_2$ contained within said vessel within predetermined temperature limits;

pump means associated with said liquid inlet/outlet port for discharge of liquid $CO_2$ to a receiving vessel; and, a storage vessel filling means including a first conduit connected to said pump for discharge of liquid $CO_2$ to an inlet means of a storage vessel and a second conduit to receive gaseous $CO_2$ from an outlet means of said storage vessel for return of said gaseous $CO_2$ to said gas inlet port associated with said storage tank.

Suitably said system for transportation and delivery of low pressure liquid $CO_2$ is adapted for mounting on a mobile vehicle. Preferably said system for transportation and delivery of liquid $CO_2$ is mounted on a base and is removably attachable to said mobile vehicle.

Preferably said cooling means comprises an evaporator means associated with a refrigeration system, said evaporator means being located within said at least one tank in an upper region normally occupied by gaseous $CO_2$.

Preferably said at least one tank is thermally insulated.

Preferably said pump means is adapted to discharge liquid $CO_2$ selectively at high pressure for filling high pressure liquid $CO_2$ storage vessels and at low pressure for filling low pressure liquid $CO_2$ storage vessels.

Preferably said first and second conduits comprise retractable flexible hose assemblies.

According to yet a further aspect of the invention there is provided a system for storage and transportation of liquid $CO_2$ at low pressures, said system characterized in the provision of a closed circuit for filling of pressure vessels containing low pressure $CO_2$, said closed circuit comprising:

a first conduit connectable at one end to a source of low pressure liquid $CO_2$ below the liquid level of said source and connectable at an opposed end to an inlet port of a liquid $CO_2$ storage vessel, said inlet port having an opening adjacent a lower wall of said storage vessel; and a second conduit connectable at one end to a gas outlet port communicating with the interior of said storage vessel at an upper part thereof normally occupied by gaseous $CO_2$ and connectable at an opposed end with a gas inlet port associated with said source, said system in use causing low pressure liquid $CO_2$ to be introduced into a storage vessel adjacent a lower wall thereof and simultaneously gaseous $CO_2$ occupying a space between the level of liquid within said storage tank being returned to said source via said second conduit to prevent excess gas pressure occurring in said storage tank during a filling operation.

By way of illustration various preferred embodiments of the invention will now be described with reference to the accompanying drawings in which FIG. 1 is a schematic view of a system for manufacture, transportation and storage of low pressure liquid carbon dioxide;

Figure 1:
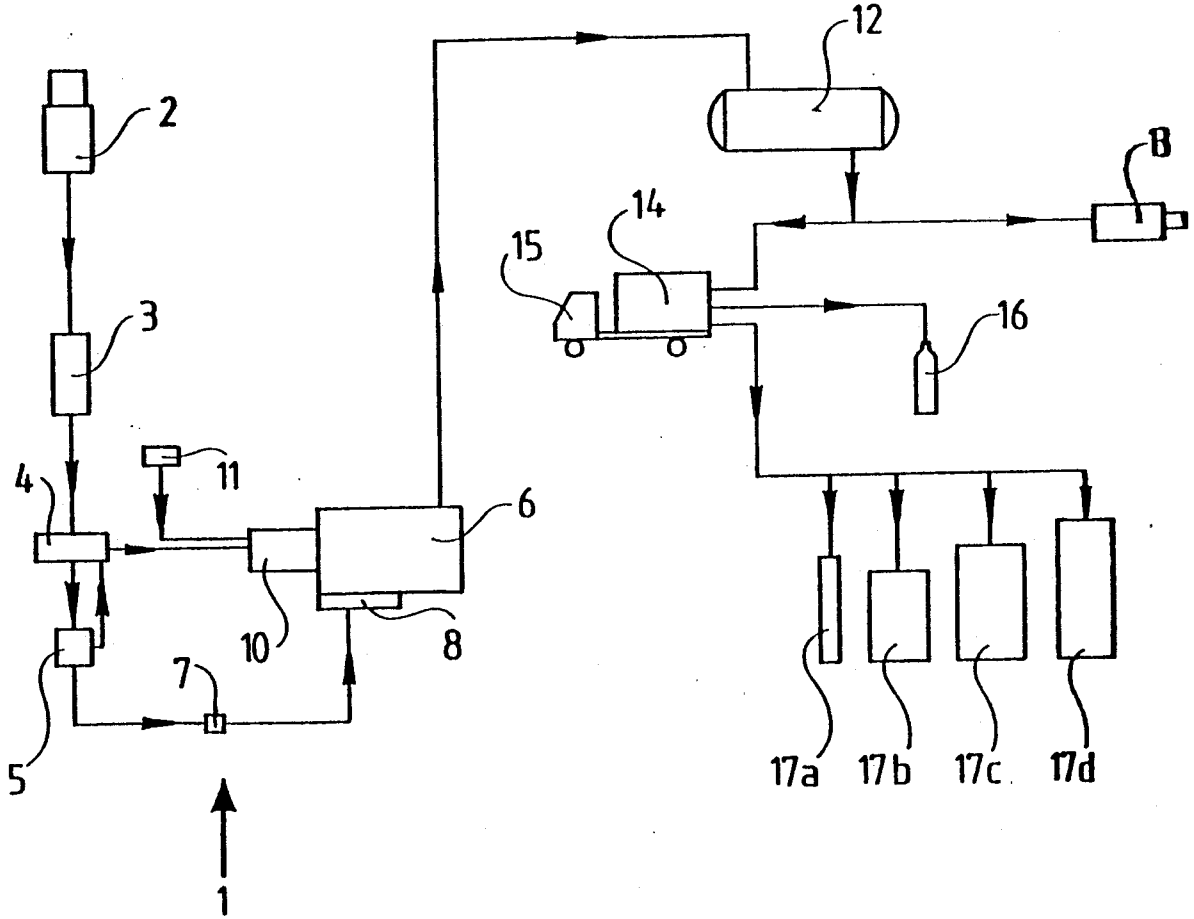

In FIG. 1 gaseous carbon dioxide is produced by a conventional $CO_2$ generating system shown generally at 1. Such a generating system may comprise a gasifier 2 to provide a source of producer gas from a carbonaceous fuel such as coal, preferably anthracite. Waste mineral oils may be introduced into the top of the gasifier 2 and as the waste oil passes down the interior of the gasifier over the anthracite, portion of the oil is volatilized and portion undergoes combustion while impurities and tars are collected at the bottom of the gasifier 2.

Oil enriched producer gas then passes to a gas scrubber 3 of conventional design for washing and cooling with water.

The washed and cooled gas is then directed to the intake manifold of an internal combustion engine 4 via a suitable metering device such as a carburettor or the like and provides a fuel source for the engine. The engine 4 in turn is connected to an electrical power generation system 5 which in turn provides electrical power for a carbon dioxide plant 6. An isolating switch 7 isolates power supply to a control panel 8 associated with the carbon dioxide plant 6.

The exhaust gases from the engine 4 are then fed to a gas burner 10 of known type to complete the combustion of any carbon monoxide in the exhaust gas. Alternatively or additionally the gas burner 10 may receive a source 11 of carbonaceous gas in the form of waste flue gas from a combustion process employing a carbonaceous fuel.

After recombustion of the exhaust gases in gas burner 10 the flue gas from the gas burner are washed and cooled in a water scrubber and then directed to an absorption tower for extraction of $CO_2$. Suitably the $CO_2$ gas is selectively absorbed from the flue gas in an aqueous MEA/soda ash solution.

The $CO_2$ enriched absorber liquor is then preheated in a heat exchanger before passing to a conventional stripper/reactivator to release absorbed $CO_2$ from the enriched absorber liquor. Released $CO_2$ is then directed at plant operating pressure to a condenser to cool the $CO_2$ gas and to remove water vapour from the gas.

A control valve maintains a constant pressure within the stripper/reactivator and after passage through a compressor of conventional type, liquefied $CO_2$ is passed to a bulk storage tank 12 for refrigerated storage at a pressure of 1600–2300 KPa and a temperature of 10° C. to −25° C. preferably −17° C.

Liquid $CO_2$ may then be used to make dry ice utilizing a conventional dry ice manufacturing apparatus 13. In a typical dry ice manufacturing apparatus, liquid $CO_2$ is allowed in a snow cone to form a "snow" of solid $CO_2$ crystals. The $CO_2$ "snow" falls into a rain opening and the ram compresses the snow into solid blocks of desired shape and size. Suitably the "snow" is compressed against a die plate having a plurality of shaped orifices. The compressive action of the ram extrudes the solid $CO_2$ through the die plate orifices to form shaped, i.e. cylindrical, slugs of dry ice.

In the dry ice manufacturing apparatus, gaseous $CO_2$ formed by evaporation of the liquid $CO_2$ or sublimation of the solid $CO_2$ is collected and passed to a compressor before being returned to bulk storage via the main compressor.

The bulk stored liquid $CO_2$ may also be decanted into a mobile refrigerated low pressure storage tank 14 on a delivery vehicle 15. The liquid $CO_2$ is maintained in the mobile storage tank 14 under conditions similar to the bulk storage tank 12. As described hereinafter in more detail the vehicle mounted mobile storage tank is adapted for filling conventional high pressure $CO_2$ cylinders 16 as well as on site low pressure storage tanks 17*a*,17*b*,17*c* and 17*d* each of differing capacities, for example 140 kg, 300 kg, 500 kg and 800 kg respectively.

Figure 2:
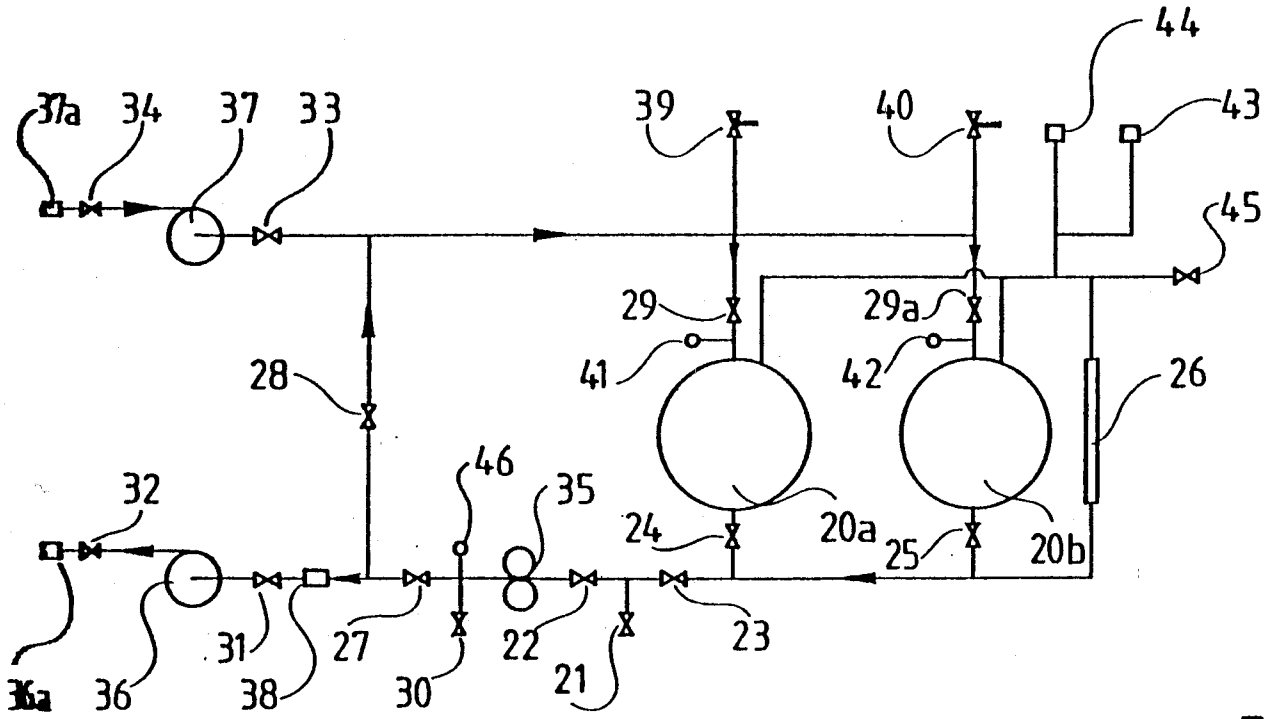
FIG. 2 is a schematic view of a mobile delivery system for low pressure liquid $CO_2$.

FIG. 2 shows schematically a flow system for liquid and gaseous $CO_2$ in a vehicle mounted mobile transportation and delivery system.

The delivery vehicle suitably comprises a flat top tray truck and the mobile liquid $CO_2$ transportation and delivery system shown schematically in FIG. 2 is assembled as a complete unit mounted on a skid base or support frame. For reasons of compactness and economy the liquid $CO_2$ is stored for transportation in a pair of tanks 20*a*,20*b* mounted on a skid base. The tanks 20*a*,20*b* are refrigerated and insulated with polyurethane foam. The refrigeration system (described later with reference to FIG. 3) is powered by a small petrol fuelled internal combustion engine mounted on the skid base supporting tanks 20*a*,20*b*. The engine is connected to an alternator to provide a source of electrical power.

The tanks 20*a*,20*b* are filled from the bulk storage tank system shown in FIG. 1. The tanks 20*a*,20*b* are filled via filling valve 21 with valve 22 closed and valves 23,45 open. Valve 39 is connected to a return line for collection of gaseous $CO_2$ above the liquid level in tanks 20*a*,20*b*. Collected gas is returned to bulk storage tank 12 for condensation to a liquid. Valves 24 and 25 are then opened separately to selectively fill respective tanks 20*a*,20*b*. A sight glass 26 enables an operator to determine when each tank is full. The mobile tank is maintained at a temperature of −17° C. and a pressure of about 1800 KPa, similar to the bulk storage tank from which the mobile tank is filled.

When filling an on site storage tank either of valves 24 or 25 may be opened as required as well as valves 23,22,27 and 28 and depending on which tank is to be used either of valves 29 or 29*a* are also opened.

Valves 21,30,31,32,33 and 34 are maintained in a closed position and pump 35 is actuated to recirculate liquid $CO_2$ from a tank, say tank 20*a*, via outlet valve 24 and thence to inlet valve 29. This serves to ensure that pump 35 is primed with liquid $CO_2$.

Hoses on hose reels 36 and 37 are then run out to the on site storage tank and connector 36*a* is connected to the inlet valve of the storage tank and connector 37*a* is connected to the outlet valve of the storage tank. When the hoses are connected to the storage tank valve 28 is closed then valves 24,23,22,27,31 and 32 on the inlet line are opened and valves 34,33 and 29 on the return line are opened. The volume of liquid $CO_2$ being delivered to the on site storage tank is metered by meter 38.

When the low pressure on site storage tank is filled, liquid $CO_2$ enters at the bottom of the tank and gaseous $CO_2$ occupies the upper part of the tank. Rather than bleeding off the gas occupying the upper part of the tank, this gas is collected in the return line via the hose connected to hose reel 37 and the gas returns to the upper part of tank 20*a* where it is condensed to a liquid state by a refrigeration evaporator (not shown) located in the upper part of tank 20*a*.

Safety relief valves 39,40 are connected to tanks 20*a*,20*b* respectively to relieve pressure build up in the tanks beyond a predetermined safe value. Pressure gauges 41,42 provide a ready visual indication of the pressures respectively in tanks 20*a*,20*b*.

A pressure actuated switch means 43 operates to switch on the refrigeration system (not shown) associated with the storage tanks 20*a*,20*b* to reduce the temperature of the gaseous $CO_2$ in the upper portion of the tanks. The refrigeration of the gas causes the temperature of the gaseous and liquid $CO_2$ to drop and thus lowers the gas pressure in the tanks to a predetermined level at which the refrigeration system is deactivated.

An alarm 44, preferably audible, is provided to signal the fact that the gas pressure inside the storage tanks 20*a*,20*b* has reached an unsafe level and in the event of failure of the refrigeration system valves 29,29*a* may be opened to allow gas to escape via pressure relief valves 39,40. Alternatively valve 45 may be opened to relieve pressure in both tanks simultaneously.

Pump 35 is a dual pressure pump of conventional type and is capable of high volume low pressure flow for filling on site storage tanks as well as low volume, high pressure flow for filling conventional high pressure gas cylinders to pressures of about 14000 KPa. High pressure gas cylinders are filled via valve 30 with which is associated a pressure gauge 46 to monitor the filling of the cylinder. Because the high pressure cylinders are filled from the top, there is no need for a return line to return-accumulated gaseous $CO_2$.

Figure 3:
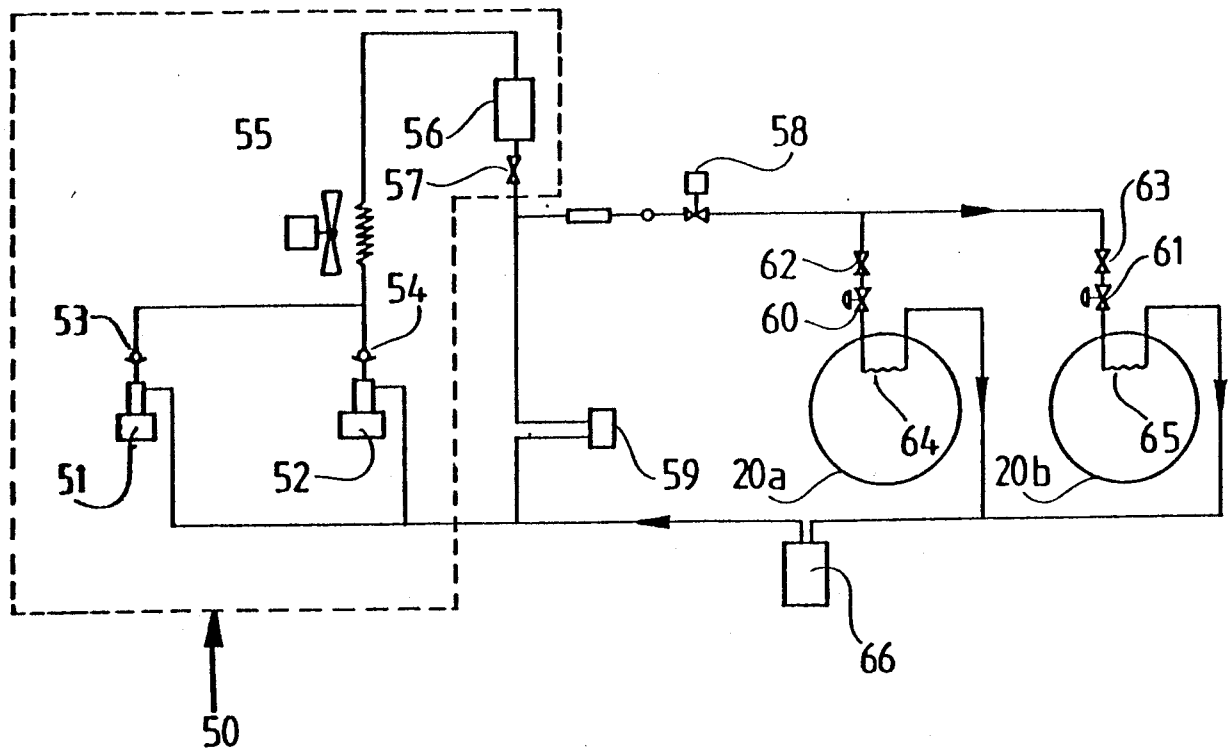
FIG. 3 is a schematic view of a coolant system for the mobile delivery vehicle storage tank system shown in FIG. 2.

FIG. 3 shows the refrigeration system associated with the mobile tanks of FIG. 2.

The refrigerating system shown generally at 50 is of a conventional type and employs dual refrigerant compressors 51, 52 to enable continued operation in the event of failure or maintenance requirements for one of the compressors. One way check valves 53,54 are associated respectively with compressors 51,52 on the high pressure outlet lines of the compressors. Refrigeration system 50 includes a condenser 55 a liquid refrigerant receiver 56 and an isolating valve 57.

Between the high pressure outlet side of the refrigerating system 50 and the mobile liquid $CO_2$ storage tanks 20*a*,20*b* are a conventional filter/drier device 67 a sight glass 68, an electrically actuable solenoid valve 58, isolating valves 62,63 and thermostatic expansion valves 60,61 respectively, all of conventional type.

Located in the upper portion of each tank 20*a*,20*b* are refrigerant evaporators 64,65 which are located in a space normally occupied by gaseous $CO_2$. The evaporators 64,65 are connected via low pressure accumulator 66 where any absorbed moisture in the hot refrigerant vapour is removed to prevent its entry into the refrigerant compressor.

Connected between the high pressure refrigerant outlet line and low pressure return line is a dual pressure control switch 59. When excess pressure occurs in tanks 20*a*,20*b*, pressure actuated switch 43 (in FIG. 2) actuates solenoid valve 28 which permits refrigerant to circulate through evaporators 64,65 to lower the tank pressures by lowering the temperature of the $CO_2$ in the storage tank.

Pressure control switch 59 also serves to electrically isolate compressors 51,52 in the event of failure of condenser 55 or in the event of a blockage in the refrigerant line.

Figure 4:
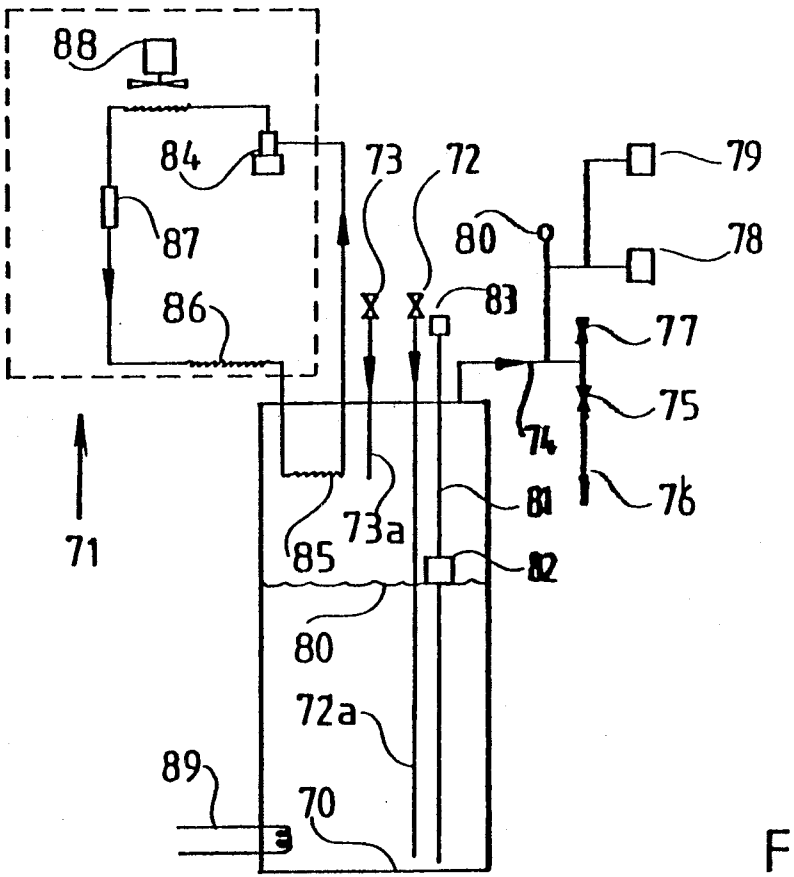
FIG. 4 is a schematic view of an on site storage system for receiving and storing low pressure liquefied carbon dioxide delivered by the system shown generally in FIG. 2.

FIG. 4 shows schematically an on site storage tank. The tank 70 comprises a pressure vessel (preferably cylindrical) which is insulated with polyurethane foam. The inlet for liquid $CO_2$ comprises an inlet valve 72 connected to which is an elongate inlet conduit 72*a* extending to near the bottom of tank 70. An outlet for gaseous $CO_2$ comprises an outlet valve 73 connected to a short conduit 73*a* positioned in the upper region of the tank. A liquid level detection device of conventional type having an elongate rod 81 and a captive float 82 is located within the tank and a level gauge 83 indicates the liquid level.

Located within the upper part of tank 70 is a refrigerant evaporator 85 connected in circuit with a conventional refrigeration system shown generally at 71 and comprising a compressor 84, capilliary 86, drier/filter 87 and condenser 88.

On the $CO_2$ take off line 74 is a branched connection one side of which is the supply line 76 having associated therewith an isolation valve 75 and a safety relief valve 77 to vent gaseous $CO_2$ in the event of excess pressure in the system.

On the other side of the branched line 74 is located a pressure gauge 80 and a pressure actuable switch 78 which is operable when a predetermined pressure is reached within the tank to actuate the refrigerating system 71 to cool the gaseous $CO_2$ at the top of cylinder 70 and thereby reduce tank pressure to a predetermined level at which the refrigerating system is switched off.

A further pressure actuable switch 79 is provided to actuate an alarm system in the event of excess pressure build up due to refrigeration system failure or the like. In the event of excessive demand on the storage tank, heavy draw-off of $CO_2$ can cause the liquid $CO_2$ to boil thus resulting in a temperature reduction and consequent reduction or at least variation in the line pressure in supply line 76. To overcome this difficulty a thermostatically controlled heating element 89 is provided to maintain the liquid $CO_2$ within predetermined temperature limits.

From the foregoing description it can be seen that the invention, in its various aspects, provides an inexpensive but elegantly effective alternative to the use of high pressure $CO_2$ cylinders as a source of low pressure gaseous $CO_2$.

We claim:

1. A storage system for storage of liquid $CO_2$ at low pressure, said storage system comprising:

a pressure vessel having inlet means and outlet means for filling said vessel, said inlet means comprising a conduit having an opening communicating with the interior of said vessel adjacent a bottom wall of said vessel and said outlet means having an opening communicating with the interior of said vessel adjacent an upper wall of said vessel;

a cooling means located within said vessel in an upper part thereof in a region normally occupied by gaseous $CO_2$;

a liquid level indicating device extending through said pressure vessel to adjacent the bottom wall thereof; and a supply conduit for supply of gaseous $CO_2$ from the pressure vessel, said supply conduit communicating with a region normally occupied by said gaseous $CO_2$, the supply conduit being branched into two lines, one line containing an isolation valve and the other line containing a pressure actuatable switch which is operable when a predetermined pressure is reached within the pressure vessel to actuate the cooling means.

2. A storage system as claimed in claim 1, wherein said cooling means comprises an evaporator located within the pressure vessel in a region normally occupied by gas and which is associated with a refrigeration apparatus exterior of the pressure vessel.

3. A storage system as claimed in claim 2, wherein said cooling means comprises an evaporator associated with a compression refrigeration apparatus.

4. A storage system as claimed in claim 1, wherein a heating means is located within the lower portion of said pressure vessel in a region normally occupied by liquid $CO_2$.

5. A storage system as claimed in claim 21, wherein said heating means comprises an electrically energized heating element.

6. A storage system as claimed in claim 2, wherein said storage system is portable.

7. A storage system as claimed in claim 1, wherein said pressure vessel is thermally insulated.

8. A storage system as claimed in claim 1, wherein the supply conduit includes a pressure relief valve to vent gaseous $CO_2$ in the event of excess pressure in the system.

9. A storage system as claimed in claim 8, wherein the pressure relief valve is located on said one line.

10. A storage system as claimed in claim 1, wherein said other line includes a pressure gauge.

11. A storage system as claimed in claim 1, wherein said supply conduit includes a pressure actuatable switch to actuate an alarm system in the event of excess pressure build up in the system.

* * * * *